United States Patent [19]

Such et al.

[11] 4,049,509

[45] Sept. 20, 1977

[54] PLATING

[75] Inventors: Tony Eugene Such, Wythall; Apoloniusz Wyszynski, Sutton Coldfield; Barrie Sydney James, Aston, all of England

[73] Assignee: W. Canning & Company Limited, Birmingham, England

[21] Appl. No.: 671,498

[22] Filed: Mar. 29, 1976

Related U.S. Application Data

[63] Continuation-in-part of Ser. No. 500,524, Aug. 26, 1974, abandoned, which is a continuation of Ser. No. 254,426, May 18, 1972, abandoned.

[30] Foreign Application Priority Data

May 16, 1972 United Kingdom ..... 1379025/72

[51] Int. Cl.[2] ..... C25D 3/12

[52] U.S. Cl. ..... 204/49

[58] Field of Search ..... 204/49

[56] References Cited

U.S. PATENT DOCUMENTS

| | | | |
|---|---|---|---|
| 2,863,926 | 12/1958 | Carpenter et al. | 260/615 R |
| 3,041,256 | 6/1962 | Kleiner et al. | 260/615 B |
| 3,268,593 | 8/1966 | Carpenter et al. | 260/615 B |
| 3,366,557 | 1/1968 | Foulke et al. | 260/615 B R |
| 3,644,535 | 2/1972 | Batty et al. | 260/615 B |
| 3,711,384 | 1/1973 | Lyde | 260/615 UX |
| 3,839,465 | 10/1974 | Schneider et al. | 260/615 R |

FOREIGN PATENT DOCUMENTS

| | | | |
|---|---|---|---|
| 970,268 | 6/1964 | United Kingdom | 260/615 B |
| 970,269 | 6/1964 | United Kingdom | 260/615 B |

*Primary Examiner*—R. L. Andrews
*Attorney, Agent, or Firm*—Marn & Jangarathis

[57] ABSTRACT

The mixture present after reaction of an acetylenic diol and less than an equimolar amount of an alkylene oxide or the like oxirane compound, and comprising a proportion of unreacted acetylenic diol starting material together with proportions of the mono-substituted and di-substituted reaction products is used as a nickel-plating bath additive. Preferred ranges for the reaction mixture of diol/oxirane are 1 : 0.5. to 1 : 0.95, and a preferred combination is 2-butyne-1,4-diol and propylene oxide.

12 Claims, 2 Drawing Figures

Figure 1:
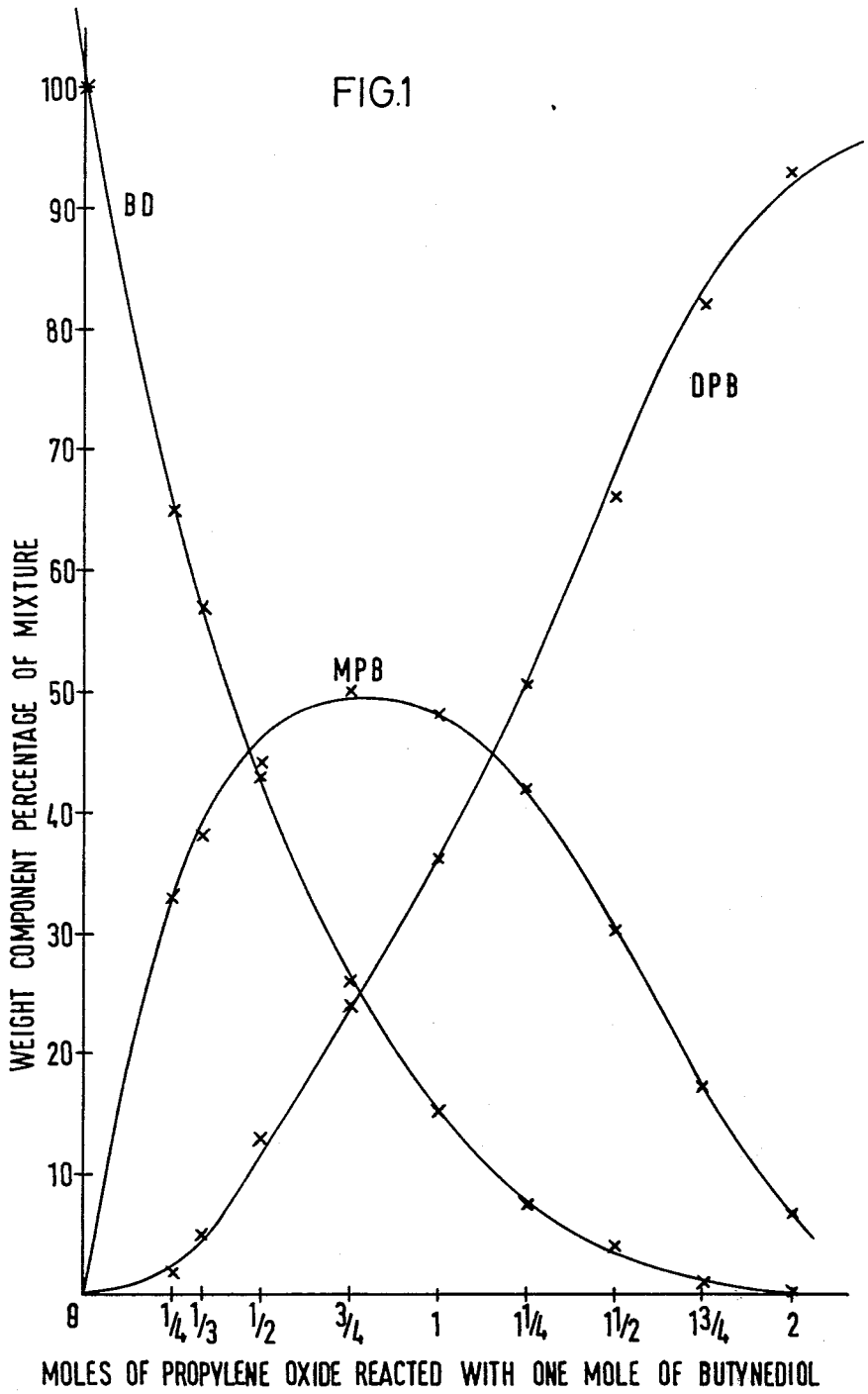

BD
MPB
DPB
WEIGHT COMPONENT PERCENTAGE OF MIXTURE
100
90
80
70
60
50
40
30
20
10
0
1/4
1/3
1/2
3/4
1
1 1/4
1 1/2
1 3/4
2
MOLES OF PROPYLENE OXIDE REACTED WITH ONE MOLE OF BUTYNEDIOL

PLATING

This application is a continuation-in-part of U.S. application Ser. No. 500,524, filed on Aug. 26, 1974, with the aforesaid application being a continuation of U.S. application Ser. No. 254,426, filed May 18, 1972 both now abandoned.

This invention relates to the electrodeposition of bright nickel from an acid plating bath, and more particularly to compounds or mixtures of compounds, which can be added to such baths to facilitate deposition of a bright and level layer of nickel.

It is well known that certain types of organic compounds are useful additives in small quantities for a nickel plating bath and facilitate the deposition of a layer which is bright and level. A bright layer is a layer which has a good specular reflectivity, while a level layer is one which fills up surface irregularities present as a result of processes such as casting, pressing, machining or grinding adopted to manufacture the article to be plated, or smooths out the micro-scratches or grooves remaining from the abrasive polishing required to eliminate, at least partially, gross surface defects in such a manufactured article. These properties and their measurement are discussed in more detail in our co-pending U.K. application No. 42615/70 now British Patent Specification 1,402,088 in which it is explained that the properties of new chemicals having a levelling and/or brightening effect cannot be accurately predicted in advance from a consideration of their chemical structure.

Known chemicals used for this purpose include unsaturated compounds, especially acetylenic compounds. Since these acetylenic compounds have to be dissolved in aqueous plating baths, water solubility is one of the desired properties and so they usually contain one or more solubilising groups, such as hydroxy, alkoxy, carboxy or sulphoxy, although their functions may extend beyond simple solubilisation for it is found their type and position within the molecule can affect the properties of the resultant nickel plate.

Acetylenic alcohols were among the first acetylenic compounds to be described for this purpose.

We have now discovered that the mixture present after the reaction between an acetylenic diol and less than an equimolar amount of an alkylene oxide or like oxirane compound is a valuable new composition, useful as an additive for an acid nickel plating bath.

The man skilled in the art will appreciate that such a mixture will generally contain unreacted starting material, monoalkoxy-substituted derivative of the acetylenic diol and dialkoxy-substituted derivative of the acetylenic diol but that (since the original diol component was in excess) formation of polymeric alkoxide compounds will be minimal so that a relatively readily water-soluble product, generally in the form of a mobile liquid, will be expected.

The preferred molar ratios between acetylenic diol and alkylene oxide or like compound appear to be from 1:0.5 to 1:0.95, with the most valuable ranges being from 1:0.75 to 1:0.85; e.g., at about 1:0.8. This ratio is especially preferred for the reaction between 2-butyne-1, 4-diol and propylene oxide. At the preferred mole ratios for reaction between 2-butyne-1, 4-diol and propylene oxide, the resulting additive will be comprised of about 45.5 to about 50 parts of monopropoxylated 2-butyne-1, 4-diol; about 11.5 to about 33.5 parts of dipropoxylated 2-butyne-1, 4-diol; and about 42.5 to about 17 parts of 2-butyne-1, 4-diol, all parts by weight, based on 100 parts of the three components. The resulting additive at the most valuable ranges is comprised of about 50 parts of monopropoxylated 2-butyne-1, 4-diol; about 23.5 to about 28.5 parts of dipropoxylated 2-butyne-1, 4-diol and about 26.5 to about 21.5 parts of 2-butyne-1, 4-diol, all parts by weight based on 100 parts of the three components. For example, at a mole ratio of 1:0.8, the composition will be comprised of about 50 parts of monopropoxylated 2-butyne-1, 4-diol; about 26 parts of dipropoxylated 2-butyne-1, 4-diol and about 23.5 parts of 2-butyne-1, 4-diol, all parts by weight, based on 100 parts of the three components.

Apparent reasons for the particular efficiency of such mixtures will be discussed below, but it is also to be noted that individual reaction products within the mixtures, where individually novel, also constitute an aspect of the present invention. Whilst our co-pending U.K. application No. 42615/70 now British Patent Specification 1,402,088 includes and specifies a number of the individual compounds of this nature, it appears that the monoethoxy, diethoxy, monopropoxy, dipropoxy, monobutoxy, dibutoxy and higher mono- and di-alkoxy substituted butyne, pentyne and hexyne diols wherein the alcohol groups are positioned on either side of the acetylenic bond are all of some utility as levelling and brightening compounds.

Figure 2:
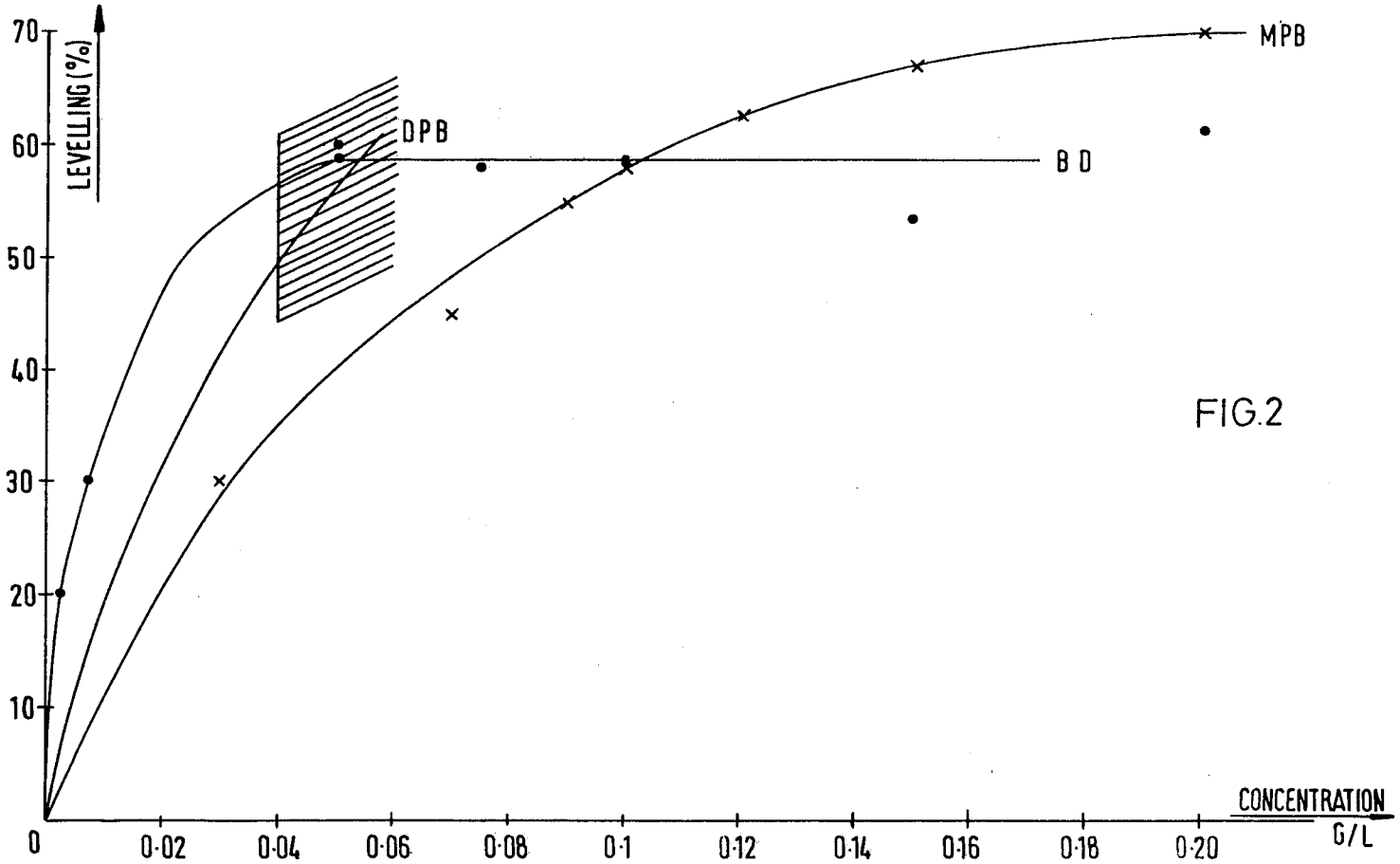

The invention will be further described with reference to the accompanying drawings, in which:

FIG. 1 is a graph which shows the weight percentages of 2-butyne-1,4-diol (BD), mono-propoxylated butyne diol (MPB) and dipropoxylated butyne diol (DPB) found in reaction mixtures obtained by reacting varying molar amounts of propylene oxide with unimolar amounts of 2-butyne-1,4-diol, and FIG. 2 is a graph which shows the levelling characteristics, measured as percentages, of BD, MPB and DPB in each instance in the presence of 1.5 g./l. of the sodium salt of saccharin.

It will be seen from FIG. 1 that if one mole of propylene oxide is reacted with one mole of BD then (when all the propylene oxide has reacted) the resultant mixture contains 15% by weight of unreacted BD, 48% by weight of MPB and 37% by weight of DPB. If three-quarters of a mole of propylene oxide is reacted with one mole of BD, then the resultant mixture contains 26% by weight of unreacted BD, 50% by weight of MPB and 24% by weight of DPB. If half a mole of propylene oxide is reacted with one mole of BD then the resultant mixture contains 43% by weight of unreacted BD, 46% by weight of MPB and 11% by weight of DPB.

It can also be seen from FIG. 1 that using less than a molar ratio of propylene oxide results in the production of much less DPB with only a small effect on the amount of MPB formed. The same types of results are obtained using other acetylenic diols and other oxiranes.

The two compounds, MPB and DPB have been isolated by fractional distillation from the reaction mixture of 2-butyne-1,4-diol and propylene oxide and subjected to proton magnetic resonance analysis:

In the case of DPB, the n.m.r. spectrum showed the following peaks:

| τ | |
|---|---|
| 8.89 | (doublet, J = 6.8$H_2$, 3H, $-CH_3$) |
| 6.58 | (doublet, J = 5.8$H_2$, 2H, $-CH_2$ . O) |
| ca 6.4 | (broad singlet, 1H, disappears on $CF_3$ . $CO_2H$ addition, OH) |
| 6.11 | [multiplet, shape consistent with a quartet of triplets, 1H, —CH . (OH).] |
| 5.74 | (singlet, 2H, . O . $CH_2$ . C≡C) |

and is consistent with the structure:

Me.CH(OH).$CH_2$.O.$CH_2$.C≡C.$CH_2$—O.$CH_2$.CH (OH).Me.

In the case of MPB the n.m.r spectrum showed the following peaks:

| τ | |
|---|---|
| 8.89 | (doublet, J = 6.8$H_2$, 3H, $-CH_3$) |
| 6.58 | (doublet, J = 5.8$H_2$, 2H, $-CH_2$ . O) |
| 6.10 | [multiplet, shape consistent with a quartet of triplets, 1H, CH (OH)] |
| ca 6.1. | [very broad, 2H, disappears on $CF_3$ . $CO_2H$ addition, 2 × OH] |
| 5.75 | (singlet, 4H, . $CH_2$ . C≡C . $CH_2$) |

and is consistent with the structure:
Me.CH(OH).$CH_2$.O.$CH_2$.C≡C.$CH_2$OH

Plating experiments were conducted using as additives to typical nickel-plating solutions nmr-pure MPB and pure DPB separated from the reaction mixtures by prolonged fractional distillation. These materials were used either individually or in mixtures of varying proportions.

In FIG. 2, the levelling values given by these individual compounds are plotted against their concentrations in the nickel-plating solution. (Saccharin was always present at a concentration of 1.5 g/l, and is typical of the sulphooxygen compounds indicated in Table 2 of our co-pending application (42615/70) now British Patent Specification 1,402,088. FIG. 2 shows that while both MPB and DPB are each effective as levelling agents, severe passivation occurs in the case of DPB at relatively low concentrations, i.e. 0.04 g/l. Similar severe passivation (exemplified by an area of black nickel plate or the complete absence of nickel plate in regions of low current density) is not encountered with MPB until a concentration of 0.4 g./l. is reached. Thus small changes in the concentration of DPB (say 0.01 g/l) can seriously affect the standard of levelling and the appearance of the electroplated deposit in recesses, holes and other portions of the component which experience only relatively low current densities, whereas if the concentration of MPB is between 0.1 and 0.4 g/l variations in its concentration have little effect on the properties of the nickel electrodeposits produced.

FIG. 2 also shows how BD exhibits a maximuum levelling limit of just under 60%. This is about the best obtainable from prior art levelling compounds, while for instance MPB present in the mixture according to the present invention, can show over 70% levelling. Moreover, as will be explained in more detail below, levelling to this 60% maximum is attained at 0.05 g./l. but passivation does not take place until a BD concentration of 0.5 g./l. is reached.

From a consideration of the results obtained in FIGs. 1 and 2 experiments were then conducted to ascertain the effects of varying the MPB/DPB ratio in mixtures thereof. These experiments were carried out in a Hull cell, using conventional nickel plating solutions containing 1.5 g./l. of the sodium salt of saccharin, and containing o-mercaptobenzoic acid (MBA) as a depolarizer in some instances. The results are shown schematically in the following Table.

The Hull cell used was the standard shaped cell and was constructed of Perspex acrylic resin — so that its dimensions were 2.5 in between the parallel sides, which were 1.35 in and 5 in long. The length of brass cathode plated was therefore 4 in, with an inclination to the anode of 38.7°. The depth of plating solution in the cell was 2 in. and a tube with upward facing perforations was placed immediately below the cathode and air bubbled through this, so as to air agitate the solution particularly in the vicinity of the cathode.

A description of commercial bright nickel plating and the basic solutions and operating conditions used for this process, typical of those to which the mixtures of the present invention are applicable, are to be found in Chapter 5 of "Nickel Plating" by R. Brugger published in 1970 by Robert Draper Ltd., Teddington.

Evaluation of Levelling by Measurement of Surface Profile

The surface roughness before and after plating was measured using a surface analyser, i.e. a 'Talysurf' instrument, which integrates the vertical movements of a stylus traversing a standard length. The surface quality was recorded in terms of centre line average (C.L.A). The initial C.L.A. of the abraded steel test panels was 1 μm, and 25 μm of nickel was electrodeposited onto them and the final C.L.A. then measured and the percentage levelling calculated using the formula:

$$\text{Percentage levelling} = \frac{\text{Initial C.L.A.} - \text{Final C.L.A.}}{\text{Initial C.L.A.}}$$

TABLE

Effect of MPB, DPB and MBA on Brightness and levelling

| | DPB | DPB MBA | MPB | MPB/ MBA | DPB/ MPB | DPB/MPB/ MBA |
|---|---|---|---|---|---|---|
| C | 0.025 | 0.025/ 0.01 | 0.025 | 0.025/ 0.01 | 0.05/ 0.05 | 0.05/0.05/ 0.01 |
| L | 36 | 32 | 25 | 23 | 58 | 53 |
| P | 15 | 0 | 0 | 0 | 35 | 10 |
| C | 0.05 | 0.05/ 0.01 | 0.05 | 0.05/ 0.01 | 0.05/ 0.075 | 0.05/0.075 0.02 |
| L | 55 | 50 | 40 | 37 | 65 | 60 |
| P | 35 | 10 | 0 | 0 | 35 | 0 |
| C | 0.10 | 0.1/ 0.03 | 0.10 | 0.10/ 0.01 | 0.05/ 0.10 | 0.05/0.10/ 0.03 |
| L | 75 | 60 | 60 | 58 | 73 | 68 |
| P | 60 | 10 | 0 | 0 | 35 | 0 |
| C | 0.15 | 0.15/ 0.03 | 0.15 | 0.20/ 0.01 | 0.03/ 0.10 | 0.03/0.10/ 0.03 |
| L | Severe ridging | Ridging | 65 | 65 | 63 | 59 |
| P | 85 | 75 | 0 | 0 | 15 | 0 |
| C | 0.25 | 0.25/ 0.05 | 0.25 | 0.25/ 0.02 | 0.03/ 0.12 | 0.03/0.12/ 0.03 |
| L | Severe ridging | Severe Ridging | 75 | 72 | 67 | 62 |
| P | 85 | 85 | 10 | 0 | 15 | 0 |

C = concentration in g./l.
L = degree of levelling, %
P = extent of passivity as a percentage of length of sample plate, measured from low current density end of panel. (Cell current of 1 × A applied)

It is obvious that MPB does not lead to passivation to a detrimental extent even at high concentrations and although DPB is apparently a more effective leveller, weight for weight, than MPB up to the 0.04 g/l level, this can be a disadvantage since small concentrations of brightener and leveller can be difficult to maintain under normal operating conditions.

Some examples reveal the benefits of using a depolariser as described in our British patent specification 920,922. o-Mercaptobenzoic acid has been chosen as a typical example of these depolarisers and the reduction in passivation experienced in higher concentrations of DPB, or MPB/DPB mixtures containing a large proportion of the latter, can be compared with those tests made in the absence of the mercaptobenzoic acid (MBA).

From FIG. 1 it will be seen that the relative weights of MPB to DPB at the limits of the preferred 0.5:1 to 0.95:1 molar proportion range of alkylene oxide to acetylenic diol are respectively approximately 4:1 and 1.5:1 respectively, with the MPB:DPB weight ratio of about 2:1 at the preferred 0.8:1 molar ratio in the reaction. In the Table there are given five examples of MPB/DPB mixtures, formed from pure comparison products, with weight ratios of 1:1, 1.5:1, 2:1 and 3.3:1 and 4:1. The results obtained, with or without the MBA depolariser, indicate the benefit of mixtures such as are produced according to the invention, wherein a useful high proportion of MPB is produced without an excess of DPB which would cause passivation. In addition the levelling and brightening effects of the MPB and DPB are additive which in practice either obviates the need for any depolariser to compensate for passivation or allows the addition of more additive for a given amount of depolariser and hence renders the deposition process less critical.

FIG. 1 also shows a levelling concentration graph for 2-butyne-1,4-diol (BD), which has a maximum levelling limit of nearly 60%. This is achieved in a concentration of 0.05 g/l and passivation may only be caused at concentrations higher than 0.5 g/l. Since the BD concentration is considerably lower (see FIG. 1) than the MPB concentration in the reacted mixture produced in the ranges of reaction mixture according to the invention its presence is not deleterious.

FIG. 1 also shows that reacting approximately 0.8 moles of propylene oxide with 1 mole of BD produces a reaction mixture which contains the maximum yield of MPB and with a relatively small proportion of DPB and unreacted BD being present. It is generally preferred from the plating agent aspect to have more of the relatively innocuous BD left in the mixture than to produce greater quantities of the much more concentration-critical DPB, as is given by higher ratios of propylene oxide to BD.

The above examples use propylene oxide and BD and these are the preferred reactants for reasons of commercial availability and ease of reaction. Other acetylenic diols (Table 1) and oxiranes (Table 2) behave in a like manner—and can be used in this invention.

Table 1

| Acetylenic diols |
|---|
| I |
| 2-Butyne-1,4-diol |
| 2-Pentyne-1,4-diol |
| 3-Hexyne-2,5-diol |
| 2,5-Dimethyl-3-hexane-2,5-diol |
| 2,4-Hexadiyne-1,6-diol |
| 4,7-Dimethyl-5-decyne-4,7-diol |

Table 2

| Oxiranes |
|---|
| Epoxy-ethane (ethylene oxide) |
| 1,2-Epoxy-propane (propylene oxide) |
| 1,2-Epoxy-butane (butylene oxide) |
| 2,3-Epoxy-butane |
| 1-Chloro-2,3-epoxypropane (epichlorohydrin) |
| 1-Butoxy-2,3-epoxypropane |
| 1-Allyloxy-2,3-epoxypropane |

The reaction between the acetylenic diol and the oxirane is advantageously catalysed by an inorganic or organic base which includes sodium or potassium hydroxide, sodium or potassium carbonate, or amines, such as trimethylamine. The choice of catalyst is, of course, determined by the effect of the catalyst on the reactants, the rate of reaction required and the solubility of the catalyst in the reactants or final solution (if a solvent is used).

In some cases (when the acetylenic diol is a liquid) the condensation may be carried out without using a solvent. However, normally a solvent is necessary and should preferably be inert such as an aliphatic ether, e.g. di-isopropyl ether, or a hetereocyclic compound, e.g. dioxane or tetrahydrofuran, or an aromatic solvent, e.g. toluene. The latter type of solvent are theoretically the best since they do not react with the oxirane themselves. Water or alcohols, e.g. methanol, can be used as solvents, since the side reaction of these compounds with the oxirane occurs in insignificant amounts and the compounds produced are not deleterious to the nickel electrodeposition process.

It will be apparent from the foregoing that the present invention is to be distinguished from those inventions described in British Pat. Nos. 864,287 and 970,269.

British Pat. No. 864,287 is concerned with reaction products between acetylenic alcohols, including diols, and an epoxide, taken in an epoxide/alcohol ratio of from 1:1 to 20:1. It is clearly envisaged that more or less polymeric compounds are obtained, and specific description is only given of reactions using at least 2 molar ratios of epoxide to acetylene alcohol. However, no specific mono-substituted compounds of the type forming part of the mixture after reaction according to the invention are detailed or alluded to and the specific type of mixtures now envisaged cannot be produced by any method described in this earlier patent.

The earlier British Patent No. 970,269 described mono- and dialkoxylated compounds and specifies, for example, the compound:

$$HOCH_2C{\equiv}C\ CH_2OCH_2CH.(CH_3)OH$$

However specified compounds are always used in conjunction with allyl sulphonic acid, the presence of which has been found inessential to this present invention.

Moreover, the type of reaction mixture now envisaged and the specific composition ranges set forth, were in no way disclosed in this prior publication.

The present invention has been described above in relation to the novel mixture of compounds, or individual novel compounds, but is useful commercially in a number of different aspects, including:

a. a method for the electrodeposition of nickel wherein such mixtures or individual compounds are provided in the electrodeposition bath, preferably in concentrations from 0.001 to 2.0 g/l, in particular 0.01 to 0.4 g/l.

b. the bath compositions so produced c. concentrates of such bath compositions d. articles plated by the method as above, and e. additives for nickel plating baths, whether start-up or maintenance additives, containing one or more mixtures or individual compounds according to the invention (optionally with other brightening and/or levelling agents and optionally with a depolarising agent) either present as such or dissolved or suspended in a liquid medium innocuous to the eventual nickel plating solution.

In this specialised art the compounds of this invention are brighteners of the second class and are generally used with brighteners of the first class which include but are not limited to sulpho-oxygen compounds, such as aryl and unsaturated alkyl sulphonamides, sulphimides and sulphonates. Typical compounds of this nature are specified in our copending application 42615/70 now British Patent Specification 1,402,088.

The constituents of the plating bath according to the preferred practice of the invention are:

1. Water

2. Nickel sulphate, nickel chloride, nickel sulphamate, or a mixture of any two or all three of these nickel salts.

3. The organic addition agent of this invention

4. A sulphonate, a sulphonamide, a sulphimide or one or more sulphonates, sulphonamides, sulphimides, or mixtures thereof of the type previously indicated in Table 2 of our application 42615/70 now British Patent Specification 1,402,088.

5. A thio-carboxylic acid or one or more of its water-soluble salts of the type and concentration described in our previous British patent specification 920922 (optional).

6. A wetting agent (optional).

An additional and often essential ingredient of the solution is a buffering agent such as boric acid, formic acid, acetic acid or the like.

Some of the plating solutions which give better bright, ductile nickel deposits when containing the co-operating addition agents dissolved therein are listed below, although satisfactory results can be obtained with these when dissolved in the concentrations mentioned herein in any plating bath containing more than 100 g/l of nickel sulphate, nickel chloride or nickel sulphamate or a combination of two or three of these salts, provided their solubility limits are not exceeded.

EXAMPLES

Some of the plating solutions in connection with which the bright, ductile nickel deposits are realized when containing the co-operating addition agents dissolved therein are quoted below:

| | | |
|---|---|---|
| **EXAMPLE 1** | | |
| Nickel sulphate | ($Ni\ SO_4 . 6H_2O$) | 300 g/l |
| Nickel chloride | ($Ni\ Cl_2 . 6H_2O$) | 40 g/l |
| Boric acid ($H_3BO_3$) | | 40 g/l |
| Sodium o-benzoyl sulphimide (sodium saccharin) | | 2.0 g/l |
| o-Mercaptobenzoic acid | | 0.02 g/l |
| Reaction mixture from one mole of 2-Butyne-1,4-diol and 0.85 mole propylene oxide | | 0.15 g/l |
| **EXAMPLE 2** | | |
| Nickel sulphate | ($Ni\ SO_4 . 6H_2O$) | 300 g/l |
| Nickel chloride | ($Ni\ Cl_2 . 6H_2O$) | 40 g/l |
| Boric acid | ($H_3BO_3$) | 40 g/l |
| Sodium o-benzoyl sulphimide (sodium saccharin) | | 1.5 g/l |
| Sodium allyl sulphonate | | 0.20 g/l |
| Dithiodimalic acid | | 0.01 g/l |
| Reaction mixture from 1 mole of 2-butyne-1,4-diol and 0.75 mole of propylene oxide | | 0.20 g/l |

-continued

| | | |
|---|---|---|
| **EXAMPLE 3** | | |
| Nickel sulphate | ($Ni\ SO_4 6H_2O$) | 300 g/l |
| Nickel chloride | ($Ni\ Cl_2 . 6H_2O$) | 40 g/l |
| Boric acid ($H_3BO_3$) | | 40 g/l |
| Sodium o-benzoyl sulphimide (sodium saccharin) | | 1.0 g/l |
| Sodium allyl sulphonate | | 1.0 g/l |
| o-Mercapto benzoic acid | | 0.01 g/l |
| Reaction mixture from 1 mole of 2-butyne-1,4-diol and 0.8 mole of butylene oxide | | 0.15 g/l |
| **EXAMPLE 4** | | |
| Nickel sulphate | ($Ni\ SO_4 . 6H_2O$) | 400 g/l |
| Sodium chloride | | 20 g/l |
| Boric acid ($H_3BO_3$) | | 50 g/l |
| Sodium o-benzoyl sulphimide (sodium saccharin) | | 1.5 g/l |
| Reaction mixture from 1 mole 2-butyne-1,4-diol and 0.6 mole epichlorhydrin | | 0.10 g/l |
| **EXAMPLE 5** | | |
| Nickel sulphate | ($Ni\ SO_4 . 6H_2O$) | 100 g/l |
| Nickel chloride | ($Ni\ Cl_2 . 6H_2O$) | 200 g/l |
| Boric acid | ($H_3BO_3$) | 40 g/l |
| Sodium-o-benzoyl sulphimide (sodium saccharin) | | 3.0 g/l |
| o-Mercaptobenzoic acid | | 0.02 g/l |
| Reaction mixture from 1 mole of 3-hexyne-2,4-diol and 0.8 mole propylene oxide | | 0.15 g/l |
| **EXAMPLE 6** | | |
| Nickel sulphate | ($Ni\ SO_4 . 6H_2O$) | 100 g/l |
| Nickel chloride | ($Ni\ Cl_2 . 6H_2O$) | 200 g/l |
| Boric acid | ($H_3BO_3$) | 40 g/l |
| Sodium o-benzoyl sulphimide (sodium saccharin) | | 2.5 g/l |
| o-Mercaptobenzoic acid | | 0.02 g/l |
| Sodium allyl sulphonate | | 0.20 g/l |
| Reaction mixture from 1 mole of 2-butyne-1,4-diol and 0.8 mole ethylene oxide | | 0.20 g/l |
| **EXAMPLE 7** | | |
| Nickel sulphate | ($Ni\ SO_4 . 6H_2O$) | 100 g/l |
| Nickel chloride | ($Ni\ Cl_2 . 6H_2O$) | 200 g/l |
| Boric acid | ($H_3BO_3$) | 40 g/l |
| Sodium o-benzyl sulphimide (Sodium saccharin) | | 2.0 g/l |
| Sodium allyl sulphonate | | 1.0 g/l |
| Thiodipropionic acid | | 0.01 g/l |
| Reaction mixture from 1 mole of 2-butyne-1,4-diol and 0.75 moles of propylene oxide | | 0.15 g/l |
| **EXAMPLE 8** | | |
| Nickel sulphamate | ($Ni\ (SO_3NH_2)_2 . 4H_2O$) | 400 g/l |
| Nickel chloride | ($Ni\ Cl_2 . 6H_2O$) | 5 g/l |
| Boric acid | ($H_3BO_3$) | 50 g/l |
| Naphthalene 1,3,6-trisulphonic acid (sodium salt) | | 12 g/l |
| Sodium 2-ethyl hexyl sulphate | | 0.5 g/l |
| Reaction mixture from 1 mole of 2-butyne-1,4-diol and 0.09 mole of butyl glycidyl ether | | 0.05 g/l |

The constituents in classes 3 to 6 listed on page 14 can be mixed together to produce a liquid additive containing the compounds in the correct proportion to prepare and maintain a nickel plating bath according to the invention. A ready means is thus provided for the addition of the individual chemicals in the correct ratio not only as an initial addition but as mixtures of different proportions to replace these compounds as they are lost by chemical or electrochemical consumption or by physical losses resulting from "drag-out" of plating solution.

These mixtures can contain:

| | |
|---|---|
| Reaction mixture of this invention | 10 - 800 g/l |
| Sodium o-benzoyl sulphimide (sodium saccharin) | 20 - 450 g/l |
| Sodium allyl sulphonate | 0 - 100 g/l |
| o-Mercapto benzoic acid | 0 - 10 g/l |
| Sodium 2-ethyl hexyl sulphate | 0 - 5 g/l |

For example a liquid additive for a nickel plating bath already containing the required inorganic compounds, in order to prepare a bath according to this invention, could contain the following:

| Liquid Additive for Initial Make-up of bath | |
|---|---|
| Reaction mixture from 1 mole of 2-butyne-1,4-diol and 0.8 mole of propylene oxide | 18 g. |

-continued

| Liquid Additive for Initial Make-up of bath | |
|---|---|
| Sodium o-benzoyl sulphimide (sodium saccharin) | 200 g. |
| o-Mercapto benzoic acid | 2 g. |
| Sodium 2-ethyl hexyl sulphate | 25 g. |
| Water to | 1 liter |

In order to maintain this bath in optimum condition and replace the organic compounds in the proportion in which they are consumed, a liquid additive can be made containing the following:

| Liquid Additive for Maintenance Purposes. | |
|---|---|
| Reaction mixture from 1 mole of 2-butyne-1,4-diol and 0.8 mole of propylene oxide | 150 g. |
| Sodium o-benzoyl sulphimide (sodium saccharin) | 50 g. |
| o-Mercapto benzoic acid | 2 g. |
| Sodium 2-ethyl hexyl sulphate | 2 g. |
| Water to | 1 liter. |

We claim:

1. A plating additive consisting essentially of:

a. about 45.5 to about 50 parts of monopropoxylated 2-butyne-1, 4diol;

b. about 11.5 to about 33.5 parts of dipropoxylated 2-butyne-1, 4-diol; and c. about 42.5 to about 17 parts of 2-butyne-1, 4-diol, all parts by weight based on 100 parts of the three components.

2. In an acidic aqueous nickel plating bath containing at least one dissolved nickel salt and at least one additive, the improvement comprising:

said at least one additive being an additive as defined in claim 1.

3. The acidic aqueous nickel plating bath of claim 2 and further comprising a sulpho-oxygen brightener.

4. The acid aqueous plating bath of claim 3 and further comprising a depolarizing agent selected from the group consisting of thiocarboxylic acids and water soluble salts thereof.

5. The acidic aqueous nickel plating bath of claim 4 wherein the sulpho-oxygen brightener is selected from the group consisting of sulphonates sulphimides, sulphonamides and mixtures thereof.

6. A composition for a plating bath, comprising:

a plating additive as defined in claim 1; and o-mercaptobenzoic acid.

7. The composition of claim 6 and further comprising a sulpho-oxygen brightener.

8. The additive of claim 1 containing a three component mixture consisting essentially of about 50 parts of component (a), about 23.5 to about 28.5 parts of component (b) and about 26.5 to about 21.5 parts of component (c).

9. The additive of claim 1 containing a three component mixture consisting essentially of about 50 parts of component (a), about 26 parts of component (b) and about 23.5 parts of component (c).

10. A composition for a plating bath comprising:

a plating additive as defined in claim 1 dissolved in a solvent.

11. In a process for electrodepositing nickel from an acidic aqueous bath containing at least one dissolved nickel salt and at least one additive, the improvement comprising:

effecting said electrodeposition with a bath wherein said at least one additive is an additive as defined in claim 1.

12. The acid aqueous nickel plating bath of claim 5 wherein the depolarizing agent is o-mercaptobenzoic acid.

* * * * *